United States Patent [19]

Yonemoto

[11] Patent Number: 4,473,135

[45] Date of Patent: Sep. 25, 1984

[54] APPARATUS FOR CONTROLLING AN ELEVATOR

[75] Inventor: Masashi Yonemoto, Nagoya, Japan

[73] Assignee: Mitsubishi Denki Kabushiki Kaisha, Japan

[21] Appl. No.: 466,515

[22] Filed: Feb. 15, 1983

[30] Foreign Application Priority Data

Feb. 23, 1982 [JP] Japan ..... 57-27690

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 4,210,226 | 7/1980 | Ichioka | 187/29 R |
| 4,326,606 | 4/1982 | Kuzunuki et al. | 187/29 R |
| 4,350,225 | 9/1982 | Sakata et al. | 187/29 R |

OTHER PUBLICATIONS

"Hitachi Hyoran", vol. 63, No. 10 (1981-10), pp. 18-19,

Masao Nakazato et al., Development of Solid State D.C. Elevators With Microprocessor Control.

*Primary Examiner*—J. V. Truhe

*Assistant Examiner*—W. E. Duncanson, Jr.

*Attorney, Agent, or Firm*—Leydig, Voit, Osann, Mayer and Holt, Ltd.

[57] ABSTRACT

An apparatus for controlling an elevator, which comprises a managing first electronic computer for managing the service of the start and stop of an elevator cage and a controlling second electronic computer for controlling the speed of the cage in accordance with a command from said first computer, wherein when the managing first computer becomes defective, the cage is conveyed to the nearest floor by the controlling second computer and when the second computer becomes defective, the cage is conveyed at a low speed to the nearest floor by the first computer and a manual operating circuit. Therefore, regardless of which of the first and/or second computers become defective, the cage can be automatically operated to the nearest floor and the passengers in the cage can be rescued.

17 Claims, 7 Drawing Figures

APPARATUS FOR CONTROLLING AN ELEVATOR

BACKGROUND OF THE INVENTION

The present invention relates to an improved apparatus for controlling an elvator by an electronic computer.

According to conventional apparatus of this type, electromagnetic devices and units such as electromagnetic relays are mainly employed. Since electronic computers such as microcomputers have recently been developed, the computer is also used as an apparatus for controlling an elevator.

An elevator which is controlled by an electronic computer has a number of advantages such as an improved controlling performance, an increased lifetime, saves energy and the like when compared with conventional elevators which employ electromagnetic relays. However, computer controlled elevators on the other hand, have a major drawback in that when the computer malfunctions, the elevator cage generally becomes impossible to run, thereby causing passengers in the cage to be enclosed in the cage.

SUMMARY OF THE INVENTION

The present invention has been made to eliminate the above-described drawbacks accompanying conventional apparatus for controlling elevators and has for its object to provide an apparatus for controlling an elevator in which a managing and a controlling electronic computer are provided, wherein an elevator cage is driven to the nearest floor by the controlling computer when the managing computer malfunctions and the cage is driven to the nearest floor by the managing computer and a manual operating circuit when the controlling computer malfunctions, thereby allowing passengers in the cage to be safely rescued from the cage regardless of which computer mulfunctions.

Another object of the present invention is to provide an apparatus for controlling an elevator which can run an elevator cage to the nearest floor by a manual operation even if both the controlling and managing computers malfunction.

Still another object of the invention is to provide an apparatus for controlling an elevator which is simply constructed in its circuit configuration by employing a manual operating circuit for a low speed automatic operation of an elevator cage when an electronic computer malfunctions, thereby eliminating an exclusive operating circuit at its malfunctioning time.

DESCRIPTION OF THE PREFERRED EMBODIMENT

An embodiment of the invention will be described below in conjunction with FIGS. 1 to 4.

Figure 1:
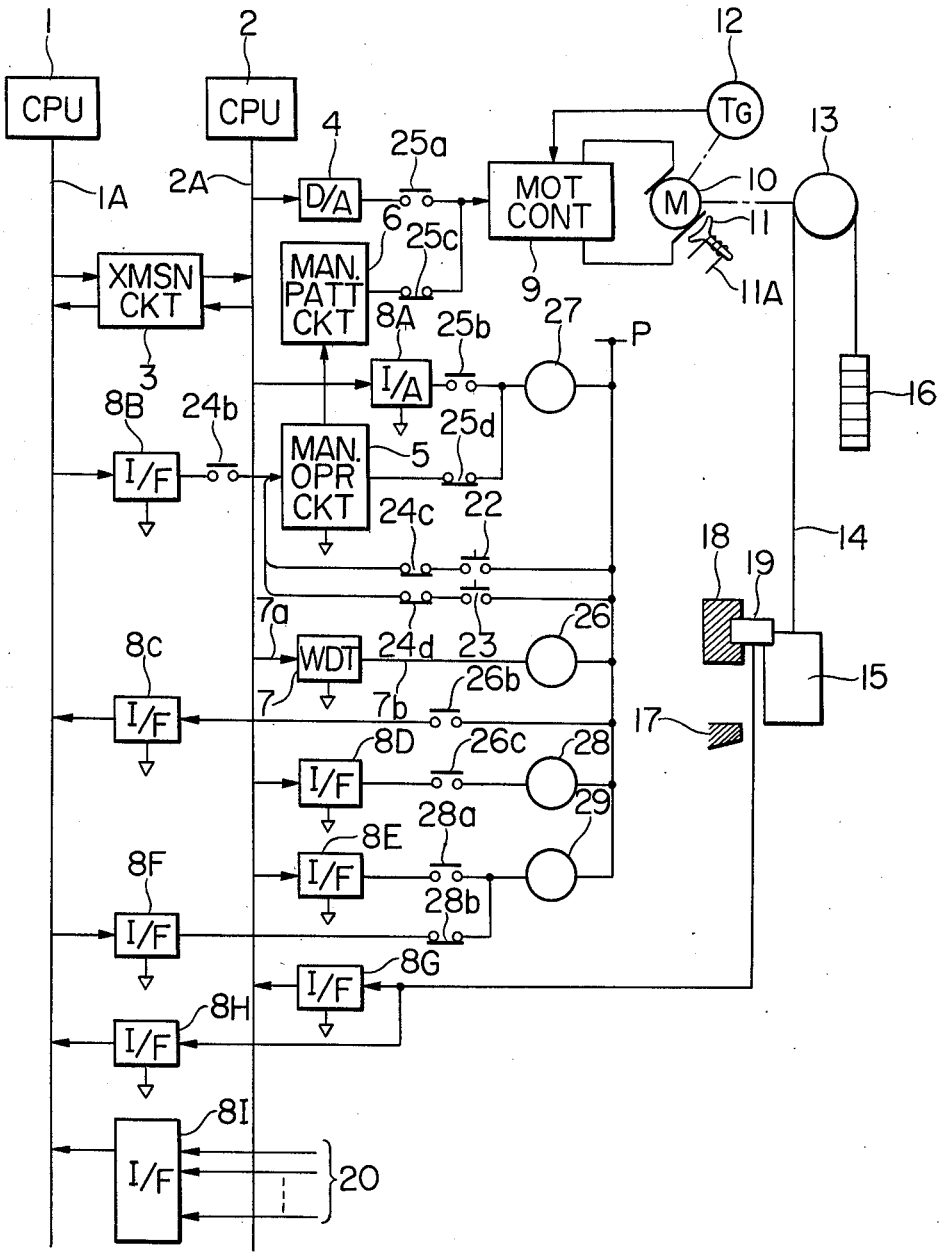
FIG. 1 is a diagram showing the construction of an apparatus for controlling an elevator according to an embodiment of the present invention.
Figure 2:
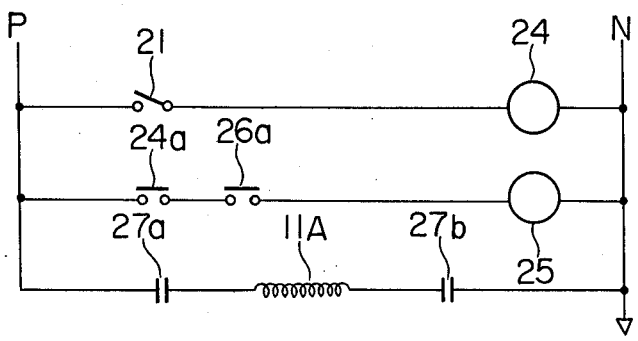
FIG. 2 is a circuit diagram of the apparatus.

In the drawings, reference character P denotes a positive electrode of a control power sorce, and N denotes a negative electrode of the power source. In FIG. 1, reference numeral 1 denotes a first electronic computer which generates a cage run instruction and a cage stop instruction to manage the service of an elevator cage 15 (to be described later), numeral 1A denotes a bus for its address and data, numeral 2 denotes a second electronic computer which calculates in accordance with instructions from the first computer 1 to generate a signal for controlling the speed of the cage 15, numeral 2A denotes its bus, numeral 3 denotes a transmission circuit which transmits and receives a signal between the computers 1 and 2, numeral 4 denotes a D/A converter which converts a digital signal inputed from the bus 2A into an analog signal, numeral 5 denotes a manual operating circuit for manually operating the cage 15, numeral 6 denotes a manual pattern circuit which generates a speed instruction at the manually operating time, numeral 7 denotes a defect detector circuit which detects a defect in the second computer 2, numeral *7a* denotes its input signal, and numeral *7b* denotes its output signal. Reference numerals 8A to 8I denote an input/output converter hereinafter termed "I/F" of the computers 1 and 2, numeral 9 denotes a motor controller as disclosed in Frederic Owen Johnson et al. Japanese Pat. No. 1,103,157 (Patent Publication No. 56-39152) "Converter Apparatus" (correspond to U.S. Ser. No. 238916), numeral 10 denotes an armature of a hoisting DC motor controlled by the controller 9 (a field is omitted), numeral 11 denotes an electromagnetic brake which restricts the armature 10 by the force of a spring (not shown) when a brake coil 11A is deenergized and which allows the armature 10 to rotate when the brake coil llA is energized, numeral 12 denotes a tachometer generator which is directly coupled to the armature 10 and which generates a speed signal, numeral 13 denotes a sheave which is driven by the armature 10 for operating a hoisting machine, numeral 14 denotes a main cable which is laid over the sheave 13, numeral 15 denotes an elevator cage which is coupled to one end of the cable 14, numeral 16 denotes a balance weight which is similarly coupled to the other end of the cable 14, numeral 17 denotes a storied floor, numeral 18 denotes an induction plate for detecting a door zone (a zone capable of opening and closing a hall door) installed in a hoistway corresponding to the floor 17, numeral 19 denotes a door zone detector which is provided on the cage 15 and which generates an output when it is adjacent to the plate 18, numeral 20 denotes calling signals such as a cage calling, a hall calling and the like, numeral 21 denotes an automatic and manual operation changeover switch, numeral 22 denotes an upward button provided in the cage 15, numeral 24 denotes an automatic operation relay which includes normal-open contacts *25a*, *26b* and normal-closed contacts *25c*, *25d*, numeral 26 denotes a defect detecting relay of the second computer 2 which includes normal-open contacts *26a* to *26c*, numeral 27 denotes a brake releasing contactor which includes normal-open contacts *27a*, *27b*, numeral 28 denotes a defect detecting relay of the first computer 1 which includes normal-open contact *28a* and normal-closed contact *28b*, and numeral 29 a door control relay which generates a door opening instruction when the relay 29 is energized and generates a door closing instruction when the relay 29 is deenergized.

Figure 3:
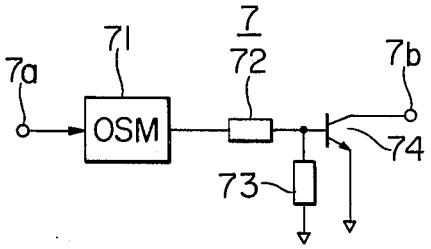
FIG. 3 is a circuit diagram of a defect detector circuit of a second, electronic computer in FIG. 1.
Figure 5A:
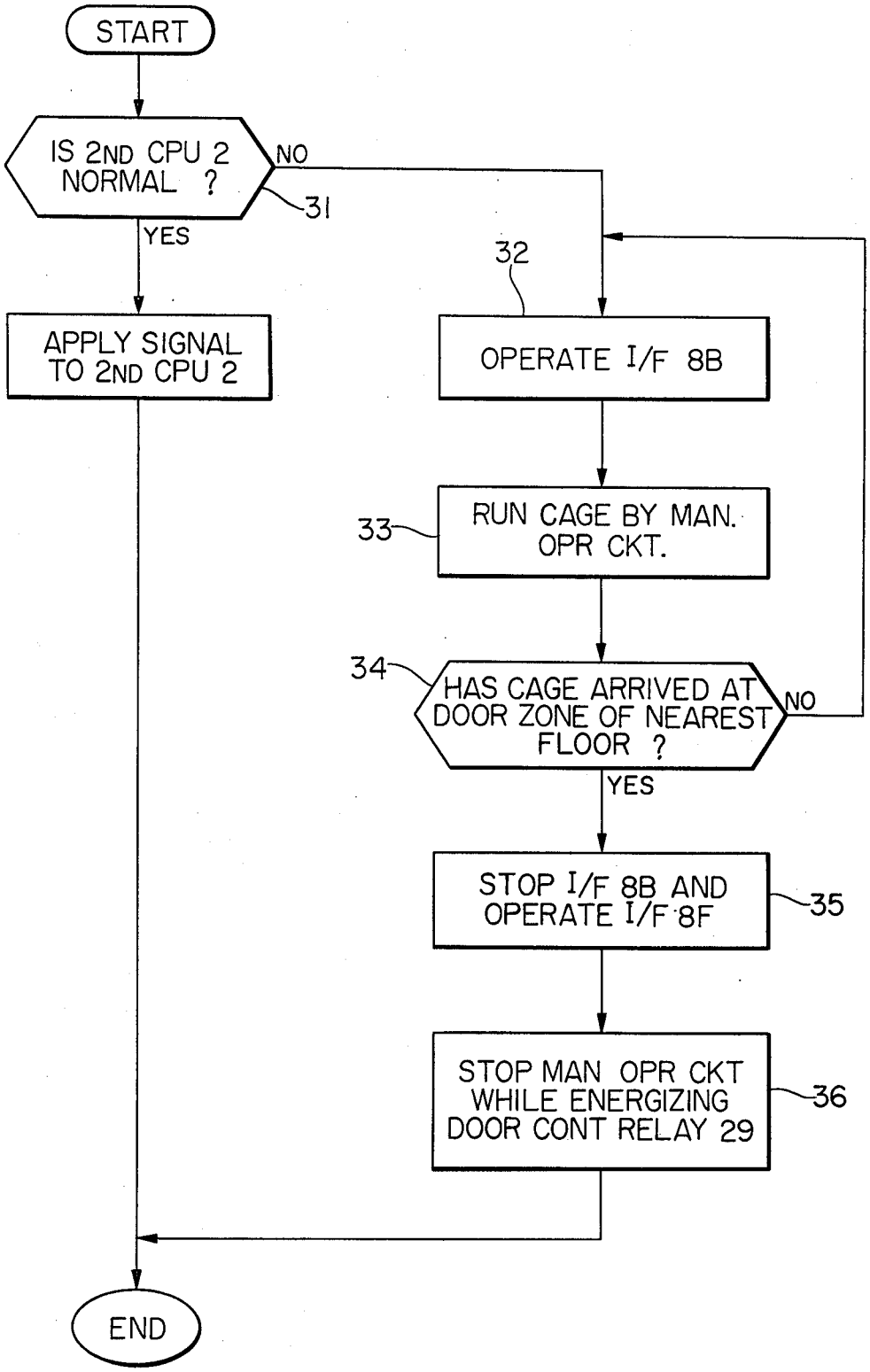
FIGS. 5A and 5B are flow charts of the operation of the program of the first and second electronic computers.
Figure 5B:
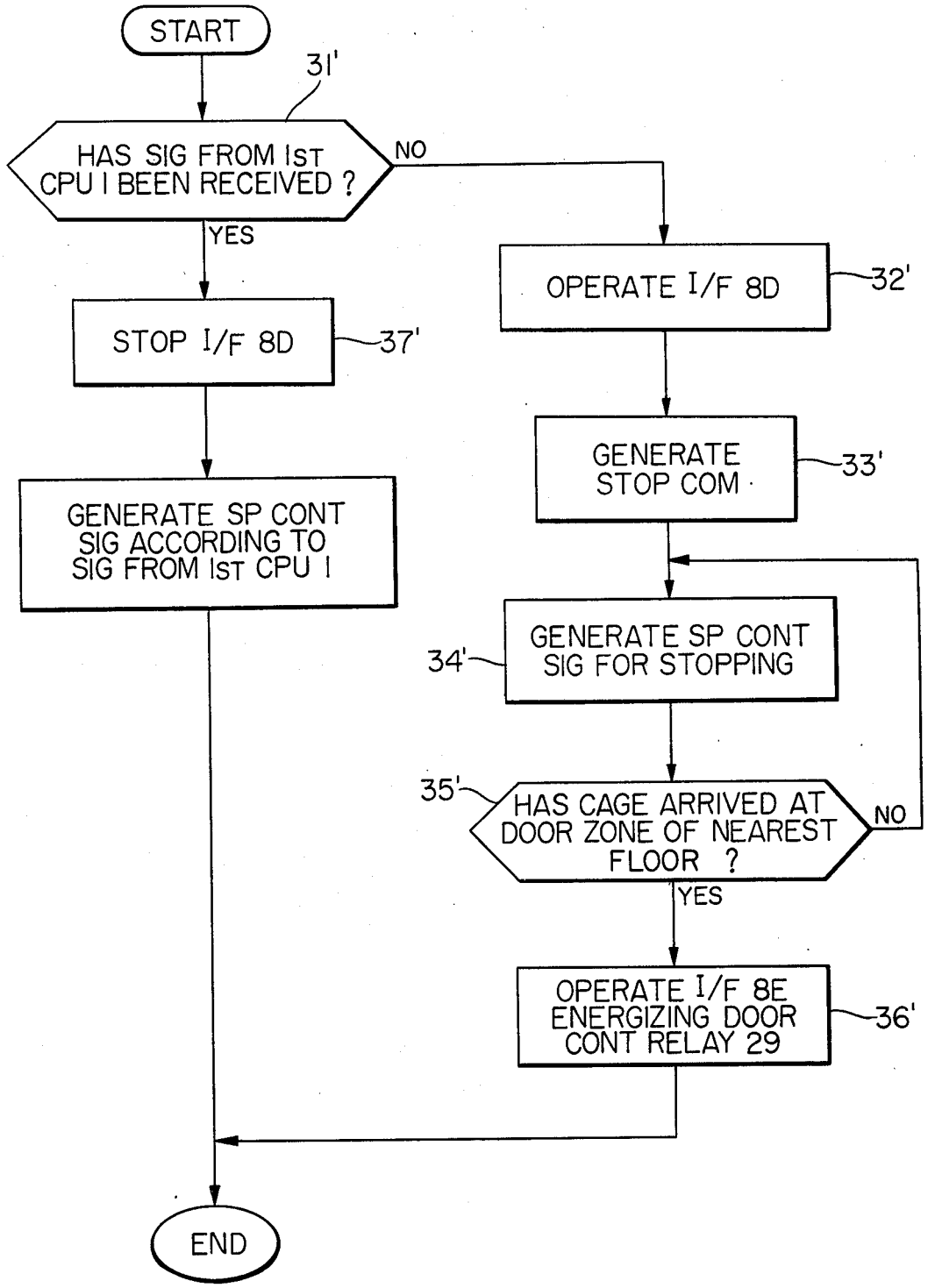

In FIG. 3, reference numeral 71 denotes a monostable element which produces a high output "H" for a predetermined period of time when an input signal *7a* goes high "H" and which is retriggerable, numeral 72, 73 denote resistors, and numeral 74 denotes a transistor. In FIGS. 5A and 5B, reference numerals 31 to 34 denote the operating sequence of the second computer 2.

The operation of the embodiment of the invention will be described here below.

A. Manual Operation

In case the changeover switch 21 is opened for check and maintenance purposes or the like of the elevator, the automatic operation relay 24 is deenergized, its contacts 24*a* and 24*b* are opened, and its contacts 24*c* and 24*d* are closed. Since the high speed operation relay 25 is deenergized by the opening of the contact 24*a* and its contact 25*c* is closed, the manual pattern circuit 6 is connected to the brake releasing contactor 27.

When a maintenance operator depresses the upward button 22, the manual operating circuit 5 is operated in a circuit of the P-22-24*c*-5. Thus, the brake releasing contactor 27 is energized, its contacts 27*a* and 27*b* are closed. Then, the brake coil 11A is energized, and the electromagnetic brake 11 is released. Thus, the restriction of the armature 10 is released, and the armature 10 is rotated in an upward elevation direction of the elevator cage 15 in accordance with the output of the manual pattern circuit 6. In this manner, the cage 15 is moved upwardly. When the operator releases his finger from the upward button 22, the operation of the manual operating cirucit 5 is stopped, and the manual pattern circuit 6 does not generate an output. Simultaneously, the brake releasing contactor 27 is deenergized and its contacts 27*a* and 27*b* are opened. Therefore, the brake coil 11A is deenergized, and the brake 11 restricts the armature 10. Thus, the cage 15 is stopped.

In case the downward button 23 is depressed, the manual operating circuit 5 is operated in a circuit of the P-23-24*d*-5, and the armature 10 is rotated similarly to the above-described operation to downwardly convey the cage 15. Thus, the cage 15 is moved downwardly.

B. Automatic Operation

Figure 4:
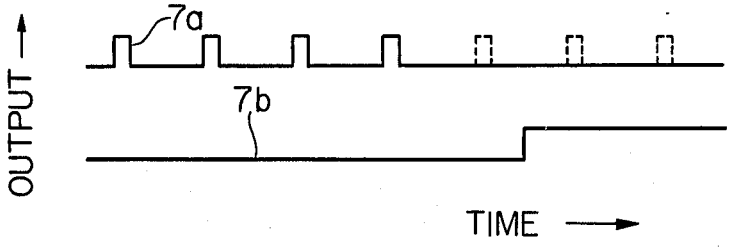
FIG. 4 is a waveform diagram showing input and output signals of FIG. 3.

When the changeover switch 21 is closed, the automatic operation relay 24 is energized, its contacts 24*a* and 24*b* are closed, and its contacts 24*c* and 24*d* are opened. In case the second computer 2 is normally operating, a pulse train *7a* is periodically produced from the computer 2, as shown in FIG. 4. Therefore, the output of the monostable element 71 becomes "H", the transistor 74 is turned on causing its output signal *7b* to be "L", the defect detecting relay 26 is energized, and its contacts 26*a* to 26*c* are closed. Thus, the high speed operation relay 25 is energized in the circuit of the P-24*a*-26*a*-25-N, its contacts 25*a* and 25*b* are closed, and its contacts 25*c* and 25*d* are closed. The D/A converter 4 is connected to the motor controller 9 by the closure of the contact 25*a*, and the I/F 8A is connected to the brake releasing contactor 27 by the closure of the contact 25*b*.

On the other hand, in case the first computer 1 is normally operated, a signal is periodically applied to the second computer 2 through the transmission circuit 3. The second computer 2 operates by this signal, as shown in FIG. 5B. More particularly, in step 31′, whether or not the second computer 1 receives a signal from the first computer 2 is determined. When the second computer 2 receives the signal from the first computer 1, the operation of the I/F 8D is stopped in step 37′. Thus, the defect detecting relay 28 is deenergized, its contact 28*a* is opened, and its contact 28*b* is closed. The I/F 8F is connected to the door control relay 29 by the closure of the contact 28*b*, and the opening and closing operations of the door are performed by the first computer 1.

When a calling signal 20 is generated and is read by the first computer 1 through the I/F 8I, the computer 1 supplies a run command to the second computer 2 via the transmission circuit 3. Thus, the computer 2 generates an output through the I/F 8A, the brake releasing contactor 27 is energized, and the brake 11 is released as described before. The computer 2 supplies a digital speed instruction signal to the D/A converter 4. In this manner, the speed instruction signal is converted into an analog amount, and is applied to the motor controller 9 through the contact 25*a*. Thus, the armature 10 is precisely automatically controlled by the above-described speed instruction signal and by a speed signal from the tachometer generator 12, and the cage 15 is caused to run. When the cage 15 approaches the storied floor 17 from which the cage 15 is called, the first computer 1 generates a stop command, so that the second computer 2 generates a speed command for stopping the cage 15, and the cage 15 is decelerated and stopped at the floor 17. When the door zone detector 19 is adjacent to the induction plate 18, an output signal is generated. This output signal is read by the first computer 1 through the I/F 8H. Then, the computer 1 produces an output through the I/F 8F, the door control relay 29 is thus energized, and the door of the cage 15 is opened.

C. Second Computer 2 Becomes Defective During Automatic Operation

In case the second computer 2 becomes defective, the pulse train *7a* is not generated, as shown in FIG. 4. Therefore, the output of the monostable element 71 becomes "L", its output signal *7b* becomes "H", the defect detecting relay 26 is deenergized, and the contacts 26*a* to 26*c* are opened. When the contacts 26*a* is opened, the high speed operation relay 25 is deenergized, its contact 25*a* is opened, and its contact 25*c* is closed. Accordingly, the motor controller 9 of the manual pattern circuit 6 is connected instead of the D/A converter 4. Since the contact 25*b* is opened, the brake releasing contactor 27 is deenergized, the brake coil 11A is deenergized, the brake 11 is operated, and the cage 15 is abruptly stopped. When the contact 26*b* is opened, its signal is loaded to the first computer 1 through the I/F 8C, the defect of the second computer 2 is detected, as shown in the step 31 of FIG. 5A. As a result, the first computer 1 generates an output through the I/F 8B, as shown in step 32, and the manual operating circuit 5 is operated through the contact 24*b*, as shown in step 33. Thus, the brake releasing contactor 27 is energized, the maual pattern circuit 6 is operated, and the cage 15 is conveyed at a low speed in accordance with the output from the manual pattern circuit 6 in the same manner as in the manual operation. The running direction of the cage 15 in this case may be either in a upward or downward direction, and an arbitrary direction may be programmed accordingly into the first computer 1. When the contact 26*c* further remains open, the defect detecting relay 28 is disconnected, and the operation of the door control relay 29 is effectively conducted via the first computer 1.

When the cage 15 arrives at the nearest floor 17 and the door zone detector 19 is adjacent to the induction plate 18, as shown in step 34, the first computer 1 stops the I/F 8B to disconnect a command to the manual operating circuit 5. Thus, the cage 15 is stopped. Simultaneously, the computer 1 generates an output through the I/F 8F, the door control relay 29 is energized through the contact **28*b*, and the door of the cage 15** is opened. Therefore, passengers in the cage can be rescued.

As described above, when the seocnd computer 2 becomes defective, the cage 15 is automatically run at a low speed to the nearest floor by the first cimputer 1 and the manual operating circuit 5.

D. First Computer Becomes Defective During Automatic Operation

In case the first computer 1 becomes defective, a signal from the transmission circuit 3 to the second computer 2 does not appear for a relatively long period of time. Thus, the second computer 2 is operated, as shown in FIG. 5B. More particularly, as shown in step 31', the fact that the above-described signal is not received is detected, and the I/F 8D is operated as shown in step 32'. Since the contact **26*c* is closed at this time, the defect detecting relay 28 is energized, the contact 28*a* is closed, and the contact 28*b* is opened. Then, the I/F 8E is connected to the door control relay 29 by the closure of the contact 28*a*, and the opening and closing operations of the door of the cage 15 can be carried out by the second computer 2. Then, the second computer 2 generates a stop command to be generated from the first computer 1 as shown in step 33' of FIG. 5B. The cage 15 thus arrives at the nearest floor 17, the door zone detector 19 generates an output signal. In step 35', this signal is inputed to the second computer 2 through the I/F 8G. Then, as shown in step 36', the computer 2 generates an output through the I/F 8E, and energizes the door co relay 29 through the contact 28*a*. Therefore, the door of the cage 15 is opened, and the passengers in the cage 15** can be rescued.

In this manner, when the first computer 1 becomes defective, the cage 15 is conveyed to the nearest floor by the second computer 2.

Even for the case where both the first and second computers 1 and 2 become defective, the switch 21 is opened, so that the cage 15 can be conveyed by the manual operation with the upward button 12 or the downward button 23, thereby readily returning to the normal operation.

Figure 6:
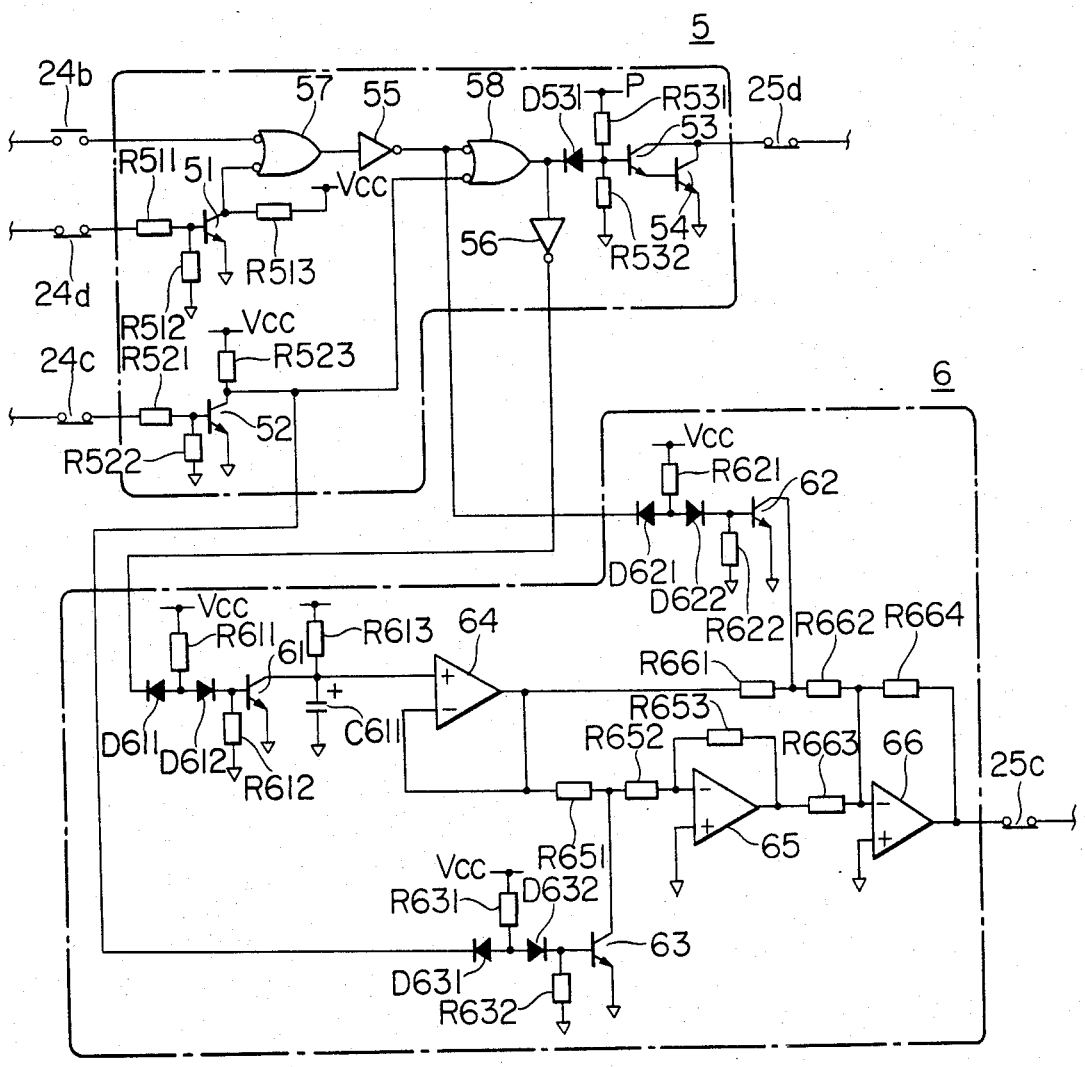
FIG. 6 is a circuit diagram showing an example of a manual operating circuit and a manual pattern circuit.

FIG. 6 illustrates the internal constructions of the manual operating circuit 5 and the manual pattern circuit 6.

Reference numerals 51 to 54 denote transistors, numerals 55 and 56 denote inverters, numerals 57 and 58 denote NAND gates, numerals R511 to R513, R521 to R523, R531, R532. R611 to R613, R621, R622, R631, R632, R651, R652, R661 to R664 denote resistors, numeral D531 denotes a diode, numerals 61 to 63 denote transistors, numeral 64 to 66 denote operational amplifiers, numeral C611 denotes a capacitor, and Vcc denotes a power source for the logic circuit.

Operation of this embodiment of FIG. 6 will be described below as exemplified in the case that a maintenance operator depresses the downward button 23 at the manual operating time.

When the downward button 23 is depressed, a circuit of **P-23-24*d*-R511-51 is formed, the transistor 51 is thereby conductive and a signal to the NAND gate 57 becomes "L". Thus, the output of the NAND gate 57 becomes "H", the output of the inverter 55 becomes "L", the output of the NAND gate 58 becomes "H", the diode D531 becomes non-conductive, and the transistors 53 and 54, which are connected in a Darlington manner become conductive. In this manner, the manual operating circuit 5 is operated, and the brake releasing contactor 27** is energized.

The "H" output of the NAND gate 58 is inverted to "L" by the inverter 56, a current from the power source Vcc is allowed to flow through the diode D611, the transistor 61 thus goes into a non-conductive state, and the capacitor C611 starts charging through the resistor R613. The operational amplifier 64 serves as a voltage follower. In other words, the amplifier 64 operates as an amplifier having a gain of 1 and having a high input impedance and a low output impedance. Therefore, the voltage on the output of the operational amplifier 64 increases with the charging of the capacitor C611.

On the other hand, the transistor 62 becomes non-conductive due to the output "L" of the inverter 55. Since the downward button 23 is now depressed and the upward button 22 is not depressed, the transistor 52 is non-conductive, causing the transistor 63 to be conductive and the input to the operational amplifier 65 is short-circuited causing its output to become zero.

The output of the operational amplifier 64 is applied to the operational amplifier 66 through the resistors R661 and R662. Since the operational amplifier 66 is an inverting amplifier, a negative polarity instruction pattern is generated, and the elevator is operated in accordance with this pattern.

In case the upward button 22 is depressed, the output of the inverter 55 becomes "H", the transistor 62 is conductive, and the transistor 63 is off. In this manner, the output of the operational amplifier 64 is inverted in polarity by the operational amplifier 66. Accordingly, this output is again inverted in polarity by the operational amplifier 6 to generate a positive polarity manual pattern, and the motor is driven in accordance with this positive porality manual pattern.

In case the second computer 2 becomes defective, a signal which is applied from the first computer 1 through the contact **24*b* is inputted to the NAND gate 57, the cage 15 is conveyed at a low speed in the same manner described for the manual operation in a downward direction, and arrives at the nearest floor 17**.

In the above described embodiment, the cage 15 travels downward. However, it is not intended to limit this invention to only a downward direction and the cage 15 could be made to move upward.

What is claimed is:

1. Apparatus for controlling the operation of an elevator cage by an electronic computer, which comprises:

a first electronic computer for generating a run command and a stop command for said cage;

a second electronic computer the input of which receives the run command and the stop command from said first computer for generating a command for controlling the speed of said cage;

a manual operating means for running said cage by a manual operation;

a defect detecting means for detecting a defect or defects in said first or second computer when said first or second computers becomes or become defective;

a first means for stopping said cage at the nearest floor by said second computer when a defect in said first computer is detected by said defect detecting means; and a second means for running said cage at a low speed to the nearest floor by said first computer and said manual operating means when a defect in said second computer is detected by said defect detecting means.

2. Apparatus for controlling an elevator as set forth in claim 1 wherein:

said defect detecting means comprises a first defect detector for detecting a defect in said first computer when said first computer stops supplying a signal to said second computer.

3. Apparatus for controlling an elevator as set forth in claim 2 wherein:

said first defect detector comprises a second computer and detects a defect in said first computer by detecting the interruption of signals supplied from said first computer.

4. Apparatus for controlling an elevator as set forth in claim 1 wherein:

said defect detecting means comprises a second defect detector for detecting a defect in said second computer by detecting the presence or absence of an operation signal generated in said second computer.

5. Apparatus for controlling an elevator as set forth in claim 4 wherein:

said second defect detector comprises a monostable element which is controlled by an operation signal generated in said second computer.

6. Apparatus for controlling an elevator as set forth in claim 1 wherein:

said first means comprises a second computer and allows said second computer to generate a stop command when a defect in said first computer is detected.

7. Apparatus for controlling an elevator as set forth in claim 6 wherein:

said second computer generates a speed control signal for stopping said cage at the nearest floor when the stop command is generated.

8. Apparatus for controlling an elevator as set forth in claim 7 wherein:

said second computer generates a command for opening the door of said cage when said cage arrives at the door opening and closing capability zone of the nearest floor.

9. Apparatus for controlling an elevator as set forth in claim 1 wherein:

said second means comprises a first computer and a manual operating means wherein said first computer supplies an operation signal to said manual opeating means when said defect detecting means detects a defect in said second computer thereby causing said cage to run at a low speed to the nearest floor.

10. Apparatus for controlling an elevator as set forth in claim 9 wherein:

said first computer stops supplying the operation signal to said manual operating means when said cage running at the low speed arrives at the door opening and closing capability zone of the nearest floor.

11. Apparatus for controlling an elevator as set forth in claim 10 wherein:

said manual operating means generates a signal for stopping the running of said cage when the input of the operation signal is interrupted.

12. Apparatus for controlling an elevator as set forth in claim 9 wherein:

said second computer generates a command for opening the door of said cage when said cage running at a low speed arrives at the door opening and closing capability zone of the nearest floor.

13. Apparatus for controlling an elevator as set forth in claim 1 wherein said apparatus further comprises:

door opening and closing control means, which is controlled by said second computer when said first computer becomes defective and which is controlled by said first computer when said second computer becomes defective.

14. Apparatus for controlling an elevator as set forth in claim 1 wherein said apparatus further comprises:

a changeover switch for switching between a manual operation and an automatic operation.

15. Apparatus for controlling an elevator as set forth in claim 14 wherein:

said elevator is operated by said manual operating means when said changeover switch is switched to the side of the manual operation and is disconnected from said first and second computers.

16. Apparatus for controlling an elevator as set forth in claim 1 wherein said apparatus further comprises:

a brake means for stopping the running of said cage wherein said brake means is driven to stop the running of said cage when said defect detecting means detects a defect in said second computer.

17. Apparatus for controlling an elevator as set forth in claim 16 wherein:

said brake means is connected to said manual operating means and is controlled by said manual operating means when a defect in said second computer is detected.

* * * * *